United States Patent [19]

Sugizawa et al.

[11] 4,447,263

[45] May 8, 1984

[54] BLADE MEMBER OF CERMET HAVING SURFACE REACTION LAYER AND PROCESS FOR PRODUCING SAME

[75] Inventors: Taijiro Sugizawa; Hironori Yoshimura; Junichi Toyama, all of Tokyo, Japan

[73] Assignee: Mitsubushi Kinzoku Kabushiki Kaisha, Tokyo, Japan

[21] Appl. No.: 427,279

[22] Filed: Sep. 29, 1982

[30] Foreign Application Priority Data

| | | | |
|---|---|---|---|
| Dec. 22, 1981 | [JP] | Japan | 56-207795 |
| Jan. 7, 1982 | [JP] | Japan | 57-1211 |
| Jan. 14, 1982 | [JP] | Japan | 57-3486 |

[51] Int. Cl.[3] ..... B22F 7/02; C22C 29/00; C22C 32/00

[52] U.S. Cl. ..... 75/233; 75/238; 75/244; 428/469; 428/698; 428/699; 428/551; 427/226; 427/227; 427/399; 427/255.1; 427/225.4; 419/13; 419/14; 419/16; 419/5; 419/29

[58] Field of Search ..... 75/233, 238; 428/469, 428/698, 699, 551; 427/226, 227, 399, 255.1, 255.4; 419/13, 14, 16, 5, 29

[56] References Cited

U.S. PATENT DOCUMENTS

| | | | |
|---|---|---|---|
| 3,971,656 | 7/1976 | Rudy | 419/57 |
| 4,279,651 | 7/1981 | Fujimori et al. | 75/233 |
| 4,330,333 | 5/1982 | Gibbs | 75/238 |

FOREIGN PATENT DOCUMENTS

| | | | |
|---|---|---|---|
| 154559 | 12/1980 | Japan | 75/238 |
| 154560 | 12/1980 | Japan | 75/238 |

*Primary Examiner*—Brooks H. Hunt

*Attorney, Agent, or Firm*—Cushman, Darby & Cushman

[57] ABSTRACT

A blade member for cutting tools comprises a cermet substrate having on a surface thereof a reaction layer. The reaction layer is composed of carbo-nitride of at least two metals in groups $IV_A$, $V_A$ and $VI_A$, the metals including Ti. The reaction layer may be composed of oxy-carbo-nitride of the above metals. The reaction layer may consist of inner and outer layers, the inner layer being composed of carbo-nitride of the above metals while the outer layer is composed of oxy-carbo-nitride of the above metals. The blade members with the reaction layer exhibits excellent toughness, wear resistance and thermoplastic deformation resistance. There is also disclosed a process for producing the above blade member.

7 Claims, No Drawings

BLADE MEMBER OF CERMET HAVING SURFACE REACTION LAYER AND PROCESS FOR PRODUCING SAME

BACKGROUND OF THE INVENTION

1. Field of the Invention

This invention relates to a blade member or insert of cermet for cutting tools having a wear-resistant and thermoplastic deformation-resistant reaction layer on a surface thereof, the blade member being suited for high speed cutting.

2. Prior Art

Conventionally, cermets, containing as hard phase-constituting components a major proportion of titanium carbide (TiC) and/or titanium nitride (TiN), have been extensively used to form blade members or inserts for high speed cutting tools such as a turning tool, since such hard cermets are superior in wear-resistance to cemented tungsten carbide. However, such cermet blade members have not met the requirement of very high speed cutting operation of above 200 m/minute. Therefore, in order to meet this requirement, hard ceramics containing a major proportion of aluminum oxide ($Al_2O_3$) have been proposed to form a blade member capable of very high speed cutting. However, such ceramics contain no binder and therefore are inferior in toughness. As a result, the use of such ceramics blade members has been limited to high speed finish cutting.

There has also been proposed and extensively used a high speed-cutting blade member made of cemented tungsten carbide and having on its surface a composite coating layer or layers composed of at least one material selected from the group consisting of TiC, TiN, titanium oxide (TiOx) and $Al_2O_3$. Such coating layers are usually formed by a chemical vapor deposition process using reaction gas such as titanium tetrachloride, methane gas, hydrogen gas and nitrogen gas. Therefore, a deposition apparatus for forming such coating is large in size, and manufacturing costs of such surface-coated blade member are also increased. Further, the constituent parts of the deposition apparatus are susceptible to corrosion due to hydrochloric acid produced by chlorine gas generated upon decomposition of titanium tetrachloride. In addition, means for preventing leakage of such hydrochloric acid should be provided from a viewpoint of safety. Further, when the coating is formed on the blade member of cemented tungsten carbide by means of the chemical vapor deposition process, a decarburized $\eta$ phase is inevitably formed in its substrate immediately below the deposited coating. The presence of such a decarburized phase will lower the toughness of the blade member so that the blade member will not always have a satisfactory cutting performance.

SUMMARY OF THE INVENTION

It is therefore an object of this invention to provide a blade member of cermet having on its surface a reaction layer which exhibits excellent wear resistance and thermoplastic deformation resistance, whereby the blade member exhibits excellent cutting performance particularly when a high speed cutting operation is carried out.

Another object is to provide a process for producing such a blade member.

According to the present invention, there is provided a blade member for cutting tools which comprises a substrate of cermet containing, apart from impurities, 10 to 35% by volume of at least one binder metal selected from the group consisting of Fe, Co, Ni, Cr, Mo, W and Al, 5 to 40% by volume of at least one compound selected from the group consisting of carbides and nitrides of metals in groups $IV_A$, $V_A$ and $VI_A$ of the periodic table as hard phase-constituting components, and balance titanium carbide and titanium nitride as main hard phase-constituting components (volume ratio of titanium nitride to titanium carbide plus titanium nitride is 0.2 to 0.6), said substrate having on a surface thereof a reaction layer composed of carbo-nitride of at least two metals in groups $IV_A$, $V_A$ and $VI_A$ of the periodic table, said at least two metals including Ti, and said reaction layer having an average thickness of 0.5 to 15.0 $\mu$m.

According to a second aspect of the invention, a reaction layer on a cermet substrate of the above-mentioned components is composed of oxy-carbo-nitride of at least two metals in groups $IV_A$, $V_A$ and $VI_A$ of the periodic table, said at least two metals including Ti. This reaction layer has an average thickness of 0.5 to 10.0 $\mu$m.

According to a third aspect of the invention, a reaction layer on a cermet substrate of the above-mentioned components consists of inner and outer layers. The inner layer is composed of carbo-nitride of at least two metals in groups $IV_A$, $V_A$ and $VI_A$ of the periodic table, said at least two metals including Ti. The inner layer has an average thickness of 0.2 to 15.0 $\mu$m. The outer layer is composed of oxy-carbo-nitride of at least two metals in groups $IV_A$, $V_A$ and $VI_A$ of the periodic table, said at least two metals including Ti. The outer layer has an average thickness of 0.2 to 10.0 $\mu$m. The combined average thicknesses of the inner and outer layers is 0.5 to 20.0 $\mu$m.

The above-mentioned reaction layers on the cermet substrates exhibit excellent wear resistance and thermoplastic deformation resistance when a cutting operation is carried out at a high cutting speed of 150 to 250 m/min. using these blade members.

The starting materials of the cermet substrate are in the form of powder. These powder materials are mixed together and then compacted into a densified solid body. This densified solid body is sintered under vacuum of not more than $10^{-1}$ torr to provide a cermet substrate. As a result, the cermet substrate has reduced nonmetallic content (mainly nitrogen content) due to denitridation during the sintering operation.

In the case where the reaction layer, composed of carbo-nitride of metals and having an average thickness of 0.5 to 15.0 $\mu$m, is formed in a surface of the cermet substrate, the cermet substrate is heated at temperatures of 1100° to 1300° C. in an atmosphere of $N_2$. The reaction layer so formed has a high hardness and a high strength of bonding to the substrate body because there exists no clear linear boundary between the reaction layer and the cermet substrate. Further, no decarburized $\eta$ brittle phase is formed immediately below the reaction layer as is the case with the chemical deposited cemented carbide substrate. Further, the hard phase-constituting components react with $N_2$ during the heating operation and are finely dispersed uniformly in the surface of the substrate so that the toughness of the resultant blade member is not lowered at all. Therefore, this blade member having the above-mentioned reaction layer is excellent in wear resistance and toughness.

The reaction layer is formed through the reaction of the denitridated surface of the substrate with $N_2$ during the heating treatment. This reaction is represented by the following formula:

$$(Ti, M)(CN)_{1-a}+(a/2)N_2 \rightarrow (Ti, M)(CN)$$

wherein M is at least one metal selected from the group consisting of metals in groups $IV_A$, $V_A$ and $VI_A$ of the periodic table except for Ti, and a is the amount of denitridation. The reaction layer should preferrably has the following composition formula:

$$(Ti, M)(CxNy)$$

wherein $0.05 \leqq x \leqq 0.4$ and $0.6 \leqq y \leqq 0.95$ are provided in terms of molar ratio.

In the reaction layer, concentrations of Ti and N become higher toward its surface, and concentrations of M and C become higher in a direction away from its surface. Thus, the reaction layer has continuous gradient of such concentration. And, the reaction layer has no free graphite or even if there exists any free graphite, the amount of free graphite is negligible since the surface of the substrate is denitridated during the sintering under vacuum of not more than $10^{-1}$ torr. As described above, the reaction layer composed of carbo-nitride of metals has an average thickness of 0.5 to 15.0 μm. If the average thickness is less than 0.5 μm, the reaction layer does not possess desired wear resistance and thermoplastic deformation resistance. On the other hand, if the average thickness exceeds 15 μm, the resultant blade member has a reduced toughness.

In the case where the reaction layer, composed of oxy-carbo-nitride of metals and having an average thickness of 0.5 to 10.0 μm, is formed in a surface of the cermet substrate, the substrate is heated at temperatures of 1100° to 1300° C. either in an atmosphere of one or both of CO and $CO_2$ or in an atmosphere of $N_2$ and one or both of CO and $CO_2$.

This reaction layer is formed through the reaction of the denitridated surface of the substrate with either CO or CO plus $N_2$ ($CO_2$ reacts with C in a reaction chamber to form CO: $CO_2+C \rightarrow 2CO$). The reaction layer composed of oxy-carbo-nitride of metals is formed either by the following reaction:

$$(Ti, M)(CN)_{1-1}+a(CO) \rightarrow (Ti, M)(CNO)$$

wherein M is at least one metal selected from the group consisting of metals in groups $IV_A$, $V_A$ and $VI_A$ of the periodic table except for Ti, and a is the amount of denitridation or by the following reaction:

$$(Ti, M)(CN)_{1-a'}+(b'/2)N_2+c'(CO) \rightarrow (Ti, M)(CNO)$$

wherein a' is the amount of denitridation ($a'=b'+c'$). The reaction layer should preferrably has the following composition formula:

$$(Ti, M)(CxNyOz)$$

wherein x is 0.2 to 0.7, y is 0.1 to 0.7 and z is 0.05 to 0.4 (molar ratio). Although the rate of formation of this reaction layer composed of oxy-carbo-nitride of metals is lower than that of the reaction layer of carbo-nitride of metals, the former is higher in wear resistance than the latter if they have the same thickness. Further, the hard phase-constituting components react with CO during the heating operation and are finely dispersed uniformly in the surface of the substrate so that the toughness of the resultant blade member is not lowered at all. Therefore, this blade member having the above-mentioned reaction layer exhibits excellent wear resistance and toughness.

In this reaction layer, concentrations of Ti, C and O become higher toward its surface, and concentrations of M and N become higher in a direction away from its surface. Thus, the reaction layer has continuous gradient of such concentration.

As described above, the reaction layer composed of oxy-carbo-nitride of metals has an average thickness of 0.5 to 10.0 μm. If the average thickness is less than 0.5 μm, the reaction layer does not possess desired wear resistance and thermoplastic deformation resistance. On the other hand, if the average thickness exceeds 10 μm, the resultant blade member has a reduced toughness.

In the case where the reaction layer, consisting of the inner layer of carbo-nitride of metals and the outer layer of oxy-carbo-nitride of metals, is formed in a surface of the cermet substrate, a base reaction layer composed of carbo-nitride of metals is first formed according to the procedure described above for the reaction layer of carbo-nitride of metals. In this case, however, the base reaction layer has an average thickness of 0.5 to 20.0 μm. The inner portion of the base reaction layer serves as the above-mentioned inner layer. Then, if there exists no free carbon in the base reaction surface of the cermet substrate, the substrate is heated at 1100° to 1300° C. in an atmosphere of CO so that the outer layer of oxy-carbo-nitride of metals is formed in the surface of the base reaction surface. Alternatively, if there exists any free carbon in the base reaction layer, the substrate is heated at 1100° to 1300° C. either in an atmosphere of $CO_2$ or in an atmosphere of $CO_2$ and CO to form the outer layer of oxy-carbo-nitride of metals in the surface of the base reaction surface. In either case, as described above, the outer layer has an average thickness of 0.2 to 10.0 μm, and the inner layer of carbo-nitride of metals has an average thickness of 0.2 to 15.0 μm. But, the combined average thickness of the inner and outer layers should be 0.5 to 20.0 μm. If the average thickness of each of the inner and outer layers is less than 0.2 μm, and if their combined average thicknesses is less than 0.5 μm, the reaction layer composed of the inner and outer layers does not possess desired wear resistance and thermoplastic deformation resistance. On the other hand, if the average thicknesses of the outer and inner layers exceed 10.0 μm and 15.0 μm, respectively, and if their combined average thicknesses exceed 20.0 μm, the resultant blade member has a reduced toughness.

The provision of the inner layer composed of carbo-nitride of metals and the outer layer composed of oxy-carbo-nitride of metals serves to further enhance the wear resistance and thermoplastic deformation resistance of the overall reaction layer.

The content of the binder metal or metals in the cermet substrate is 10 to 35% by volume. The binder metal or metals serve to enhance the toughness of the cermet substrate, and if the content of the binder metal or metals is less than 10% by volume, a desired toughness of the cermet substrate is not achieved. On the other hand, if the content exceeds 35% by volume, wear resistance of the cermet substrate is lowered.

The carbides and nitrides of metals in group $IV_A$, $V_A$ and $VI_A$ serve to improve plastic deformation resistance. Further, carbides of Mo and W serve to enhance the toughness of the cermet substrate. The content of the metal carbide and/or nitride is 5 to 40% by volume.

If its content is less than 5% by volume, the desired effects can not be achieved. If the content exceeds 40% by volume, the wear resistance of the cermet substrate is lowered, and the reaction layer on the surface of the substrate fails to exhibit excellent wear resistance.

The balance titanium carbide and titanium nitride also serve as main hard phase-constituting components of the cermet substrate. The volume ratio of titanium nitride to titanium carbide plus titanium nitride should be 0.2 to 0.6. If the volume ratio is less than 0.2, the content of titanium nitride is correspondingly low so that the amount of denitridation of the substrate during the vacuum sintering operation is too small. As a result, a considerable amount of free carbon will exist in the resultant reaction surface layer formed through the subsequent heating treatment. This would adversely affect the wear resistance of the reaction layer and the toughness of the cermet substrate. On the other hand, if the volume ratio exceeds 0.6, the content of titanium nitride is correspondingly increased so that the amount of denitridation of the surface layer of the substrate during the vacuum sintering operation is too large. As a result, the resultant blade member has a roughened surface so that its accuracy is adversely affected. In addition, the wear resistance of the reaction surface and the toughness of the blade member are lowered.

The compacted body of the powder materials should be sintered under vacuum of not more than $10^{-1}$ torr to form the cermet substrate. If the sintering is carried out under vacuum of more than $10^{-1}$ torr, the nonmetallic content (mainly, the nitrogen content) of the cermet substrate is not sufficiently reduced. As a result, the reaction layer having desired properties can not be formed in the surface of the cermet substrate at the subsequent heating treatment.

The heat treatment of the cermet substrate is carried out at temperatures of 1100° to 1300° C. If the temperature is less than 1100° C., the speed of formation of the reaction layer is lowered and therefore the production rate of the blade member is low. On the other hand, if the temperature is more than 1300° C., the reaction surface is so roughened that accuracy of the blade member is adversely affected.

The impurities contained in this cermet substrate include $O_2$, B and Si. If the content of the impurities is less than 2% by volume, they will not affect the intended properties of the cermet substrate at all.

DESCRIPTION OF THE INVENTION

The invention will now be illustrated by the following Examples:

The following Examples 1 to 3 illustrates blade members having on a surface a reaction layer composed of carbo-nitride of metals.

EXAMPLE 1

Powders of TiC (average particle size: 1.5 μm), TiN (1.0 μm), TaC (1.0 μm), WC (1.2 μm), Mo (0.8 μm), Ni (2.5 μm) and Co (1.2 μm) were prepared as starting materials. The starting materials were mixed together in predetermined amounts to provide a mixture. Then, the mixture was compacted into a densified solid body. Then, the densified body was sintered at temperature of 1450° C. for 1.5 hours under vacuum of $10^{-2}$ torr to form a cermet substrate. The cermet substrate consisted of 45% by volume TiC, 25% TiN, 5% TaC, 5% WC, 10% Mo, 4% Ni and 6% Co (the ratio of TiN to TiC plus TiN was 0.36). The cermet substrate was then ground into a shape conforming to JIS·SNP432. Cermet substrates prepared in this manner were subjected to heat treatment under conditions shown in Tabe 1 to produce blade members 1 to 7 of this invention. The composition of each reaction layer shown in Table 1 was that of the central portion of the reaction layer.

For comparison purposes, cermet substrates prepared according to the above procedure were subjected to heat treatment at temperatures above the upper temperature limit of this invention, i.e., 1300° C., to produce comparison blade members 1 and 2. Also, there were provided comparison blade member 3 of cermet containing TiC, Ni and Mo and WC-based comparison blade member 4 having on a surface 6 μm thick coating composed of a layer of TiC and layer of $Al_2O_3$. The comparison blade members 3 and 4 were commercially available.

The blade members 1 to 7 of this invention and the comparison blade members 1 to 4 were each attached to a holder and subjected to a continuous cutting test to determine wear resistance. The conditions for this continuous cutting test were as follows:

Workpiece: a bar of steel (JIS·SNCM-8; AISI·4340; Hardness: HB240)
Cutting speed: 250 m/minute
Feed rate: 0.30 mm/revolution
Depth of cut: 1.5 mm
Time: 10 minutes After this continuous cutting test, the flank wear and the crater wear of each blade member were observed. The results obtained are shown in Table 1.

Also, the blade members 1 to 7 of this invention and the comparison blade members 1 to 4 were subjected to an intermittent cutting test to determine toughness. In this intermittent test, two workpieces in the form of block were fixedly secured to a turning support member. A tool holder holding the blade member was located adjacent to the support member so that during the turning of the support member, the outer surfaces of the two workpieces were intermittently brought into cutting engagement with the blade member. In this test, it was determined how many blade members of the same construction out of ten were subjected to chipping. The conditions for this intermittent cutting test were as follows:

Workpiece: a block of steel (JIS·SNCM-8; Hardness: HB280)
Cutting speed: 140 m/minute
Feed rate: 0.3 mm/revolution
Depth of cut: 2 mm
Time: 3 minutes The results of this intermittent cutting test are shown in Table 1.

TABLE 1

| Kind of blade member | Heat treatment: Pressure of $N_2$ (torr) | Heat treatment: Heat temperature (°C.) | Heat treatment: Time (h) | Reaction layer: Composition of carbo-nitride of metals: (Ti, M) (CxNy) (molar ratio) | Reaction layer: Average thickness (μm) | Continuous cutting test: Flank wear (mm) | Continuous cutting test: Crater wear (μm) | Intermittent cutting test: Number of chipped blade members/ number of tested members |
|---|---|---|---|---|---|---|---|---|
| Blade members of this invention | | | | | | | | |
| 1 | 600 | 1240 | 10 | $(Ti_{0.80}Ta_{0.06}W_{0.03}Mo_{0.11})$—$(C_{0.18}N_{0.82})$ | 3.5 | 0.19 | 25 | 1/10 |
| 2 | 550 | 1250 | 8 | $(TI_{0.80}Ta_{0.06}W_{0.03}Mo_{0.11})$—$(C_{0.15}N_{0.83})$ | 4.0 | 0.16 | 20 | 2/10 |
| 3 | 500 | 1260 | 7 | $(Ti_{0.81}Ta_{0.06}W_{0.03}Mo_{0.10})$—$(C_{0.16}N_{0.84})$ | 4.0 | 0.16 | 20 | 2/10 |
| 4 | 450 | 1270 | 6 | $(Ti_{0.81}Ta_{0.06}W_{0.03}Mo_{0.10})$—$(C_{0.17}N_{0.83})$ | 4.0 | 0.16 | 20 | 2/10 |
| 5 | 400 | 1280 | 8 | $(Ti_{0.82}Ta_{0.05}W_{0.03}Mo_{0.10})$—$(C_{0.20}N_{0.80})$ | 6.0 | 0.14 | 15 | 3/10 |
| 6 | 450 | 1290 | 13 | $(Ti_{0.84}Ta_{0.05}W_{0.02}Mo_{0.09})$—$(C_{0.25}N_{0.75})$ | 10.0 | 0.17 | 10 | 4/10 |
| 7 | 550 | 1300 | 18 | $(Ti_{0.86}Ta_{0.04}W_{0.02}Mo_{0.08})$—$(C_{0.30}N_{0.70})$ | 15.0 | 0.20 | 10 | 6/10 |
| Comparison blade members | | | | | | | | |
| 1 | 550 | 1320* | 18 | $(Ti_{0.87}Ta_{0.04}W_{0.02}Mo_{0.07})$—$(C_{0.41}N_{0.59})$ | 17.0* | 0.28 | 10 | 10/10 |
| 2 | 550 | 1310* | 10 | $(Ti_{0.87}Ta_{0.04}W_{0.02}Mo_{0.07})$—$(C_{0.36}N_{0.64})$ | 10.0 | 0.23 | 10 | 8/10 |
| 3 | | — | | | | 0.37 | 50 | 10/10 |
| | | | | | | Plastic deformation developed | | |
| 4 | | — | | | | 0.31 | 100 | 4/10 |
| | | | | | | Plastic deformation developed | | |

*not falling within the range of this invention

As seen from Table 1, the blade members 1 to 7 of this invention exhibited excellent toughness, excellent wear resistance and excellent thermoplastic deformation resistance. On the other hand, the comparison blade members 1 to 4 were extremely inferior in such properties.

EXAMPLE 2

Powder materials described in Example 1 and powders of NbC (1.0 μm), ZrC (1.5 μm), $Mo_2C$ (1.2 μm) and TaN (1.0 μm) were selectively used as starting powder materials. The powder materials were mixed together in ratios shown in Table 2 to provide various mixtures. Each mixture was pressed into a densified solid body having a shape conforming to JIS·SNMG 432. Then, the densified solid bodies were sintered at temperature of 1450° C. for 1.5 hours under vacuum shown in Table 2 to form cermet substrates 8a to 14a of this invention and comparative cermet substrates 5a to 8a. The cermet substrates were substantially identical in composition to their respective mixtures. Then, the cermet substrates 8a to 14a of this invention were subjected to heat treatment under conditions shown in Table 3 to produce blade members 8 to 14 of this invention. Also, the comparison substrates 5a to 8a were subjected to heat treatment to produce comparison blade members 5 to 8. The substrates were subjected to the heat treatment in the above sintering furnace. Each comparison substrate had component contents not falling within this invention as indicated by mark * in Table 2. The comparison blade members 5 and 6 had free carbon in their reaction layer and at portions immediately adjacent thereto. The comparison blade member 7 had an extremely roughened surface.

The blade members 8 to 14 of this invention and the comparison blade members 5 to 8 were subjected to a continuous cutting test. The conditions for this continuous cutting test were as follows:

Workpiece: a bar of steel (JIS·SNCM-8; Hardness: HB240)
Cutting speed: 200 m/minute
Feed rate: 0.36 mm/revolution
Depth of cut: 1.5 mm
Time: 10 minutes An intermittent cutting test was also carried out under the following cutting conditions:

Workpiece: a block of steel (JIS·SNCM-8; Hardness: HB280)
Cutting speed: 120 m/minute
Feed rate: 0.3 mm/revolution
Depth of cut: 2 mm
Time: 3 minutes The results of the continuous and intermittent cutting tests are shown in Table 3.

TABLE 2

| Kind of blade member | Composition (volume %): Hard phase constituting components: TiC | TiN | TaC | NbC | ZrC | WC | $Mo_2C$ | TaN | Binder components: Mo | Ni | Co | TiN/(TiC + TiN) | Sintering vacuum (torr) |
|---|---|---|---|---|---|---|---|---|---|---|---|---|---|
| Substrates of this substrates | | | | | | | | | | | | | |
| 8a | 50 | 13 | — | — | — | 5 | — | — | 20 | 4 | 8 | 0.21 | $10^{-2}$ |
| 9a | 49 | 22 | — | — | — | 5 | — | — | 12 | 4 | 8 | 0.31 | |
| 10a | 42 | 29 | — | — | — | 5 | — | — | 12 | 4 | 8 | 0.41 | |
| 11a | 35 | 36 | — | — | — | 5 | 12 | — | — | 4 | 8 | 0.51 | $10^{-1}$ |
| 12a | 29 | 42 | — | — | — | 5 | 12 | — | — | 4 | 8 | 0.59 | |
| 13a | 31 | 20 | 10 | 5 | — | 10 | 12 | — | — | 4 | 8 | 0.39 | |
| 14a | 41 | 27 | — | — | 1 | 5 | — | 2 | 12 | 4 | 8 | 0.40 | $10^{-2}$ |
| Comparison | | | | | | | | | | | | | |

TABLE 2-continued

| Kind of blade member | Composition (volume %) | | | | | | | | | | | | Sintering vacuum (torr) |
|---|---|---|---|---|---|---|---|---|---|---|---|---|---|
| | Hard phase constituting components | | | | | | | | Binder components | | | TiN / TiC + TiN | |
| | TiC | TiN | TaC | NbC | ZrC | WC | $Mo_2C$ | TaN | Mo | Ni | Co | | |
| substrate | | | | | | | | | | | | | |
| 8a | 71* | —* | — | — | — | 5 | — | — | 12 | 4 | 8 | 0* | |
| 6a | 61* | 10* | — | — | — | 5 | — | — | 12 | 4 | 8 | 0.14* | |
| 7a | 24* | 47* | — | — | — | 5 | 12 | — | — | 4 | 8 | 0.66* | $10^{-1}$ |
| 8a | 70 | 18 | —* | —* | —* | —* | —* | —* | — | 4 | 8 | 0.20 | $10^{-2}$ |

*not falling within this invention

TABLE 3

| Kind of blade member | Heat treatment: Pressure of $N_2$ (torr) | Heat treatment: Heat temperature (°C.) | Heat treatment: Time (h) | Reaction layer: Composition of carbo-nitride metals: (Ti, M) (CxNy) (molar ratio) | Reaction layer: Average thickness (μm) | Continuous cutting test: Flank wear (mm) | Continuous cutting test: Crater wear (μm) | Intermittent cutting test: Number of chipped blade members/ number of tested members |
|---|---|---|---|---|---|---|---|---|
| Blade members of this invention | | | | | | | | |
| 8 | 500 | 1280 | 6 | $(Ti_{0.77}W_{0.04}Mo_{0.19})$—$(C_{0.23}N_{0.77})$ | 4.0 | 0.17 | 20 | 3/10 |
| 9 | | | | $(Ti_{0.84}W_{0.03}Mo_{0.13})$—$(C_{0.20}N_{0.80})$ | 4.5 | 0.15 | 15 | 3/10 |
| 10 | | | | $(Ti_{0.86}W_{0.03}Mo_{0.11})$—$(C_{0.15}N_{0.85})$ | 4.5 | 0.13 | 15 | 2/10 |
| 11 | 300 | | | $(Ti_{0.88}W_{0.03}Mo_{0.09})$—$(C_{0.12}N_{0.88})$ | 4.5 | 0.15 | 15 | 2/10 |
| 12 | | | | $(Ti_{0.89}W_{0.03}Mo_{0.08})$—$(C_{0.08}N_{0.92})$ | 4.5 | 0.20 | 10 | 4/10 |
| 13 | 500 | | | $(Ti_{0.65}Ta_{0.14}Nb_{0.06}W_{0.07}Mo_{0.08})$—$(C_{0.19}N_{0.81})$ | 4.0 | 0.19 | 25 | 1/10 |
| 14 | | | | $(Ti_{0.83}Ta_{0.04}W_{0.03}Mo_{0.10})$—$(C_{0.18}N_{0.82})$ | 4.5 | 0.17 | 20 | 2/10 |
| Comparison blade member | | | | | | | | |
| 5 | | | | $(Ti_{0.83}W_{0.03}Mo_{0.14})$—$(C_{0.56}N_{0.44})$ | 3.5 | 0.35 | 50 | 10/10 |
| 6 | | | | $(Ti_{0.84}W_{0.03}Mo_{0.13})$—$(C_{0.30}N_{0.70})$ | 4.0 | 0.30 | 30 | 7/10 |
| 7 | 300 | | | $(Ti_{0.89}W_{0.03}Mo_{0.08})$—$(C_{0.05}N_{0.95})$ | 4.5 | 0.37 | 20 | 9/10 |
| 8 | 500 | | | Ti—$(C_{0.22}N_{0.78})$ | 4.5 | 0.30 | 25 | 10/10 |

As can be seen from Table 3, the blade members 8 to 14 of this invention exhibited excellent wear resistance and excellent toughness and achieved an excellent cutting performance. On the other hand, the comparison blade members 5 to 8, whose substrates had the compositions not falling within the range of this invention, were very inferior in wear resistance and toughness and exhibited a poor cutting performance.

EXAMPLE 3

Cermet substrates, composed of 26.5% by volume TiC, 20% TiN, 10% TaC, 15% WC, 10% Mo, 5.5% Ni, 11% Co and 2% Al (the volume ratio of TiN to TiC plus TiN: 0.43), were prepared according to the procedure of Example 1. The cermet substrates were subjected to heat treatment under conditions shown in Table 4 to produce blade members 15 to 19 of this invention and comparison blade member 9. The cermet substrate not subjected to heat treatment was used as comparison blade member 10. Also, there were provided WC-based comparison blade member 11 (JIS·P10) and comparison WC-based blade member 12 having on a surface 7 μm thick coating composed of TiC layer and TiN layer.

The blade members 15 to 19 of this invention and the comparison blade members 9 to 12 were subjected to a continuous cutting test. The conditions for this continuous cutting test were as follows:

Workpiece: a bar of steel (JIS·SNCM-8; Hardness: HB240)
Cutting speed: 160 m/minute
Feed rate: 0.44 mm/revolution
Depth of cut: 1.5 mm
Time: 15 minutes An intermittent cutting test was also carried out under the following cutting conditions:

Workpiece: a block of steel (JIS·SNCM-8; Hardness: HB280)
Cutting speed: 100 m/minute
Feed rate: 0.335 mm/revolution
Depth of cut: 2 mm
Time: 3 minutes The results of the continuous and intermittent cutting tests are shown in Table 4.

TABLE 4

| Kind of blade member | Heat treatment: Pressure of $N_2$ (torr) | Heat treatment: Heat temperature (°C.) | Heat treatment: Time (h) | Reaction layer: Composition of carbo-nitride metals: (Ti, M) (CxNy) (molar ratio) | Reaction layer: Average thickness (μm) | Continuous cutting test: Flank wear (mm) | Continuous cutting test: Crater wear (μm) | Intermittent cutting test: Number of chipped blade members/ number of tested members |
|---|---|---|---|---|---|---|---|---|
| Blade members of this invention | | | | | | | | |

TABLE 4-continued

| Kind of blade member | Heat treatment: Pressure of $N_2$ (torr) | Heat treatment: Heat temperature (°C.) | Heat treatment: Time (h) | Reaction layer: Composition of carbo-nitride metals: (Ti, M) (CxNy) (molar ratio) | Reaction layer: Average thickness (μm) | Continuous cutting test: Flank wear (mm) | Continuous cutting test: Crater wear (μm) | Intermittent cutting test Number of chipped blade members/ number of tested members |
|---|---|---|---|---|---|---|---|---|
| 15 | 200 | 1100 | 16 | Not measurable | 0.5 | 0.30 | 50 | 1/10 |
| 16 | | 1150 | | $(Ti_{0.67}Ta_{0.13}W_{0.09}Mo_{0.11})$—$(C_{0.30}N_{0.70})$ | 1.0 | 0.21 | 40 | 1/10 |
| 17 | 300 | 1200 | 10 | $(Ti_{0.68}Ta_{0.13}W_{0.09}Mo_{0.10})$—$(C_{0.25}N_{0.75})$ | 2.0 | 0.19 | 30 | 1/10 |
| 18 | 400 | 1260 | 6 | $(Ti_{0.72}Ta_{0.12}W_{0.07}Mo_{0.09})$—$(C_{0.15}N_{0.85})$ | 3.0 | 0.16 | 20 | 1/10 |
| 19 | 500 | 1280 | 7 | $(Ti_{0.72}Ta_{0.12}W_{0.07}Mo_{0.09})$—$(C_{0.16}N_{0.84})$ | 4.0 | 0.15 | 20 | 2/10 |
| Comparison blade members | | | | | | | | |
| 9 | 200 | 1050* | 16 | Not measurable | 0.3* | 0.39 | 65 | 1/10 |
| 10 | | | | — | — | 0.47 | 80 | 2/10 |
| 11 | | | | — | | 0.53 | 150 | 4/10 |
| 12 | | | | — | | 0.35 | 60 | 3/10 |

*not falling within the range of this invention

As can be seen from Table 4, the blade members 15 to 19 of this invention exhibited excellent wear resistance and excellent toughness in comparison with the comparison blade members 11 and 12. The reaction layer of the comparison blade member 9 had an average thickness of 0.3 μm which is below the lower limit of the thickness range of this invention. The comparison blade member 10 had no reaction surface layer. Therefore, the two comparison blade members 9 and 10 were substantially equal in toughness to the blade members of this invention but were inferior in wear resistance.

The following Examples 4 to 6 illustrate blade members having on a surface a reaction layer composed of oxy-carbo-nitride of metals.

EXAMPLE 4

Cermet substrates were prepared according to the procedure of Example 1 using the same powder materials, the cermet substrates having the same composition as the cermet substrates of Example 1. The cermet substrates were then ground into a shape conforming to JIS·SNP432. The cermet substrates were then subjected to heat treatment in an atmosphere of $CO_2$ or in an atmosphere of $CO_2$ and $N_2$ under conditions shown in Table 5 to produce blade members 20 to 26 of this invention and comparison blade members 13 and 14. The comparison blade members 13 and 14 were produced under the conditions not falling within the range of this invention, as shown in Table 5. Also, there were provided comparison blade member 15 of cermet containing TiC, Ni and Mo and WC-based comparison blade member 16 having on a surface 6 μm thick coating composed of a layer of TiC and a layer of $Al_2O_3$.

The blade members 20 to 26 of this invention and the comparison blade members 13 to 16 were subjected to a continuous cutting test and an intermittent cutting test. The conditions for this continuous cutting test were as follows:

Workpiece: a bar of steel (JIS·SNCM-8; Hardness: HB220)
Cutting speed: 250 m/minute
Feed rate: 0.36 mm/revolution
Depth of cut: 1.5 mm
Time: 10 minutes The conditions for the intermittent cutting test were as follows:

Workpiece: a block of steel (JIS·SNCM-8; Hardness: HB280)
Cutting speed: 140 m/minute
Feed rate: 0.3 mm/revolution
Depth of cut: 2 mm
Time: 3 minutes The results of these two continuous and intermittent cutting tests are shown in Table 5.

TABLE 5

| Kind of blade member | Heat treatment: Pressure of $CO_2$ (torr) | Heat treatment: Pressure of $N_2$ (torr) | Heat treatment: Heat temperature (°C.) | Heat treatment: Time (h) | Reaction layer: Composition of oxy-carbo-nitride of metals: (Ti, M) (CxNyOz) (molar ratio) | Reaction layer: Average thickness (μm) | Continuous cutting test: Flank wear (mm) | Continuous cutting test: Crater wear (μm) | Intermittent cutting test Number of chipped blade members/ number of tested blade members |
|---|---|---|---|---|---|---|---|---|---|
| Blade members of this invention | | | | | | | | | |
| 20 | 350 | — | 1250 | 12 | $(Ti_{0.81}Ta_{0.06}W_{0.03}Mo_{0.10})$—$(C_{0.60}N_{0.20}O_{0.20})$ | 1.5 | 0.18 | 25 | 1/10 |
| 21 | 300 | — | 1260 | 10 | $(Ti_{0.81}Ta_{0.06}W_{0.03}Mo_{0.10})$—$(C_{0.60}N_{0.20}O_{0.20})$ | 2.0 | 0.16 | 20 | 2/10 |
| 22 | 250 | — | 1270 | 8 | $(Ti_{0.82}Ta_{0.05}W_{0.03}Mo_{0.10})$—$(C_{0.58}N_{0.20}O_{0.22})$ | 2.0 | 0.15 | 20 | 2/10 |
| 23 | 200 | — | 1280 | 6 | $(Ti_{0.82}Ta_{0.05}W_{0.03}Mo_{0.10})$—$(C_{0.55}N_{0.20}O_{0.25})$ | 2.0 | 0.15 | 20 | 2/10 |
| 24 | 100 | 200 | 1280 | 8 | $(Ti_{0.83}Ta_{0.05}W_{0.03}Mo_{0.09})$—$(C_{0.30}N_{0.55}O_{0.15})$ | 4.5 | 0.13 | 15 | 3/10 |

TABLE 5-continued

| Kind of blade member | Heat treatment: Pressure of $CO_2$ (torr) | Heat treatment: Pressure of $N_2$ (torr) | Heat treatment: Heat temperature (°C.) | Heat treatment: Time (h) | Reaction layer: Composition of oxy-carbo-nitride of metals: (Ti, M) (CxNyOz) (molar ratio) | Reaction layer: Average thickness (μm) | Continuous cutting test: Flank wear (mm) | Continuous cutting test: Crater wear (μm) | Intermittent cutting test Number of chipped blade members/ number of tested blade members |
|---|---|---|---|---|---|---|---|---|---|
| 25 | 100 | 300 | 1290 | 15 | $(Ti_{0.85}Ta_{0.04}W_{0.03}Mo_{0.08})$—$(C_{0.17}N_{0.65}O_{0.18})$ | 7.5 | 0.15 | 10 | 4/10 |
| 26 | 150 | 400 | 1300 | 20 | $(Ti_{0.87}Ta_{0.04}W_{0.02}Mo_{0.07})$—$(C_{0.10}N_{0.70}O_{0.20})$ | 10.0 | 0.16 | 10 | 5/10 |
| Comparison blade members | | | | | | | | | |
| 13 | 150 | 400 | 1320* | 20 | $(Ti_{0.88}Ta_{0.04}W_{0.02}Mo_{0.06})$—$(C_{0.05}N_{0.75}O_{0.20})$ | 12.0* | 0.20 | 10 | 10/10 |
| 14 | —* | —* | 1280 | 6 | — | — | 0.42 | 50 | 2/10 |
| | | | | | | | Plastic Deformation | | |
| 15 | | | | | — | | 0.39 | 55 | 10/10 |
| | | | | | | | Plastic Deformation | | |
| 16 | | | | | — | | 0.36 | 100 | 4/10 |
| | | | | | | | Plastic Deformation | | |

*not falling within this invention

As can be seen from Table 5, the blade members 20 to 26 exhibited excellent toughness, excellent wear resistance and excellent thermoplastic deformation resistance. The comparison blade members 15 and 16 were extremely inferior in these properties. The comparison blade member 13 was extremely inferior in toughness, and the comparison blade member 14 were extremely inferior in wear resistance and thermoplastic deformation resistance.

EXAMPLE 5

The same powder materials described in Example 2 were mixed together in ratios shown in Table 2 to provide various mixtures. Cermet substrates 8a to 14a and comparison substrates 5a to 8a were produced from these mixtures according to the same procedure of Example 2. The cermet substrates 8a to 14a of this invention were subjected to heat treatment under conditions shown in Table 6 to produce blade members 27 to 33 of this invention, respectively. Also, the comparison cermet substrates 5a to 8a were subjected to heat treatment under conditions shown in Table 6 to produce comparison blade members 17 to 20, respectively. The comparison blade members 17 and 18 had free carbon in their reaction layers and at portions immediately adjacent thereto. The comparison blade member 19 had an extremely roughened surface.

The blade members 27 to 33 of this invention and the comparison blade members 17 to 20 were subjected to a continuous cutting test and an intermittent cutting test.

The conditions for this continuous cutting test were as follows:

Workpiece: a bar of steel (JIS·SNCM-8; Hardness: HB260)
Cutting speed: 200 m/minute
Feed rate: 0.36 mm/revolution
Depth of cut: 1.5 mm
Time: 10 minutes The conditions for the intermittent cutting test were as follows:

Workpiece: a block of steel (JIS·SNCM-8; Hardness: HB280)
Cutting speed: 120 m/minute
Feed rate: 0.3 mm
Depth of cut: 2 mm
Time: 3 minutes The results of the continuous and intermittent cutting tests are shown in Table 6.

TABLE 6

| Kind of blade member | Heat treatment: Pressure of $CO_2$ (torr) | Heat treatment: Pressure of $N_2$ (torr) | Heat treatment: Heat temperature (°C.) | Heat treatment: Time (h) | Reaction layer: Composition of oxy-carbo-nitride of metals: (Ti, M) (CxNyOz) (molar ratio) | Reaction layer: Average thickness (μm) | Continuous cutting test: Flank wear (mm) | Continuous cutting test: Crater wear (μm) | Intermittent cutting test Number of chipped blade members/ tested members |
|---|---|---|---|---|---|---|---|---|---|
| Blade members of this invention | | | | | | | | | |
| 27 | 200 | — | 1280 | 7 | $(Ti_{0.77}W_{0.04}Mo_{0.18})$—$(C_{0.62}N_{0.13}O_{0.25})$ | 1.5 | 0.16 | 25 | 3/10 |
| 28 | | | | | $(Ti_{0.85}W_{0.03}Mo_{0.12})$—$(C_{0.58}N_{0.17}O_{0.25})$ | 2.0 | 0.14 | 20 | 2/10 |
| 29 | | | | | $(Ti_{0.86}W_{0.03}Mo_{0.11})$—$(C_{0.53}N_{0.22}O_{0.25})$ | 2.0 | 0.13 | 15 | 1/10 |

TABLE 6-continued

| Kind of blade member | Heat treatment: Pressure of $CO_2$ (torr) | Heat treatment: Pressure of $N_2$ (torr) | Heat treatment: Heat temperature (°C.) | Heat treatment: Time (h) | Reaction layer: Composition of oxy-carbo-nitride of metals: (Ti, M) (CxNyOz) (molar ratio) | Reaction layer: Average thickness (μm) | Continuous cutting test: Flank wear (mm) | Continuous cutting test: Crater wear (μm) | Intermittent cutting test Number of chipped blade members/tested members |
|---|---|---|---|---|---|---|---|---|---|
| 30 | 100 | — | | | $(Ti_{0.88}W_{0.03}Mo_{0.09})$—$(C_{0.48}N_{0.27}O_{0.25})$ | 2.0 | 0.15 | 15 | 2/10 |
| 31 | | | | | $(Ti_{0.89}W_{0.03}Mo_{0.08})$—$(C_{0.44}N_{0.30}O_{0.26})$ | 2.5 | 0.19 | 10 | 3/10 |
| 32 | 100 | 200 | | | $(Ti_{0.66}Ta_{0.13}Nb_{0.06}W_{0.07}Mo_{0.08})$—$(C_{0.88}N_{0.60}O_{0.12})$ | 4.0 | 0.18 | 20 | 1/10 |
| 33 | 100 | 200 | | | $(Ti_{0.84}Ta_{0.03}W_{0.03}Mo_{0.10})$—$(C_{0.28}N_{0.55}O_{0.17})$ | 4.0 | 0.16 | 15 | 2/10 |
| Comparison blade members | | | | | | | | | |
| 17 | 200 | — | | | $(Ti_{0.85}W_{0.03}Mo_{0.12})$—$(C_{0.88}O_{0.12})$ | 0.8 | 0.33 | 50 | 10/10 |
| 18 | | | | | $(Ti_{0.85}W_{0.03}Mo_{0.12})$—$(C_{0.71}N_{0.09}O_{0.20})$ | 1.0 | 0.29 | 35 | 6/10 |
| 19 | 100 | — | | | $(Ti_{0.89}W_{0.03}Mo_{0.08})$—$(C_{0.37}N_{0.33}O_{0.30})$ | 2.5 | 0.37 | 15 | 9/10 |
| 20 | 200 | — | | | Ti—$(C_{0.60}N_{0.12}O_{0.28})$ | 2.0 | 0.28 | 30 | 10/10 |

As can be seen from Table 6, the blade members 27 to 33 of this invention exhibited excellent wear resistance and excellent toughness and achieved a good cutting performance. On the other hand, the comparison blade members 17 to 20 whose substrates had the compositions not falling within the range of this invention, were very inferior in wear resistance and toughness and exhibited a poor cutting performance.

EXAMPLE 6

Cermet substrates, composed of 26.5% by volume TiC, 20% TiN, 10% TaC, 15% WC, 10% Mo, 5.5% Ni, 11% Co and 2% Al (the volume ratio of TiN to TiC plus TiN: 0.43), were prepared according to the procedure of Example 1. The cermet substrates were subjected to heat treatment under conditions shown in Table 7 to produce blade members 34 to 38 of this invention and comparison blade member 21. The cermet substrate not subjected to heat treatment was used as comparison blade member 22. Also, there were provided WC-based comparison blade member 23 (JIS·P10) and comparison WC-based blade member 24 having on a surface 7 μm thick coating composed of TiC layer and TiN layer.

The blade members 34 to 38 of this invention and the comparison blade members 21 to 24 were subjected to a continuous cutting test. The conditions for this continuous cutting test were as follows:

Workpiece: a bar of steel (JIS·SNCM-8; Hardness: HB260)
Cutting speed: 150 m/minute
Feed rate: 0.44 mm/revolution
Depth of cut: 1.5 mm
Time: 15 minutes An intermittent cutting test was also carried out under the following cutting conditions:

Workpiece: a block of steel (JIS·SNCM-8; Hardness: HB280)
Cutting speed: 100 m/minute
Feed rate: 0.335 mm/revolution
Depth of cut: 2 mm
Time: 5 minutes The results of the continuous and intermittent cutting tests are shown in Table 7.

TABLE 7

| Kind of blade member | Heat treatment: Pressure of $CO_2$ (torr) | Heat treatment: Pressure of $N_2$ (torr) | Heat treatment: Heat temperature (°C.) | Heat treatment: Time (h) | Reaction layer: Composition of oxy-carbo-nitride of metals (Ti, M) (CxNyOz) (molar ratio) | Reaction layer: Average thickness (μm) | Continuous cutting test: Flank wear (mm) | Continuous cutting test: Crater wear (μm) | Intermittent cutting test Number of chipped blade members/tested members |
|---|---|---|---|---|---|---|---|---|---|
| Blade members of this invention | | | | | | | | | |
| 34 | 100 | — | 1100 | | Not measurable | 0.5 | 0.25 | 40 | 1/10 |
| 35 | | | 1150 | 20 | Not measurable | 0.8 | 0.18 | 30 | 1/10 |
| 36 | | 200 | 1200 | | $(Ti_{0.69}Ta_{0.13}W_{0.08}Mo_{0.10})$—$(C_{0.50}N_{0.45}O_{0.05})$ | 2.0 | 0.16 | 15 | 1/10 |
| 37 | 200 | — | 1280 | 6 | $(Ti_{0.72}Ta_{0.12}W_{0.07}Mo_{0.09})$—$(C_{0.65}N_{0.25}O_{0.10})$ | 1.5 | 0.13 | 10 | 1/10 |
| 38 | 100 | 200 | | | $(Ti_{0.73}Ta_{0.12}W_{0.06}Mo_{0.09})$—$(C_{0.25}N_{0.60}O_{0.15})$ | 3.5 | 0.13 | 10 | 1/10 |
| Comparison blade members | | | | | | | | | |

TABLE 7-continued

| Kind of blade member | Heat treatment: Pressure of $CO_2$ (torr) | Heat treatment: Pressure of $N_2$ (torr) | Heat treatment: Heat temperature (°C.) | Heat treatment: Time (h) | Reaction layer: Composition of oxy-carbo-nitride of metals (Ti, M) (CxNyOz) (molar ratio) | Reaction layer: Average thickness (μm) | Continuous cutting test: Flank wear (mm) | Continuous cutting test: Crater wear (μm) | Intermittent cutting test Number of chipped blade members/tested members |
|---|---|---|---|---|---|---|---|---|---|
| 21 | | — | 1050* | 20 | Not measurable | 0.3* | 0.34 | 50 | 1/10 |
| 22 | | | | | — | — | 0.46 | 80 | 2/10 |
| 23 | | | | | — | | 0.52 | 150 | 5/10 |
| 24 | | | | | — | | 0.33 | 40 | 3/10 |

*not falling within the range of this invention

As can be seen from Table 7, the blade members 34 to 38 of this invention exhibited excellent wear resistance and excellent toughness in comparison with the comparison blade members 23 and 24. The reaction layer of the comparison blade member 21 had an average thickness of 0.3 μm which is below the lower limit of the thickness range of this invention. The comparison blade member 22 had no reaction layer. Therefore, the two comparison blade members 21 and 22 were substantially equal in toughness to the blade members of this invention but were inferior in wear resistance.

The following Examples 7 to 9 illustrate blade members having on a surface a reaction layer composed of an inner layer of carbo-nitride of metals and an outer layer of oxy-carbo-nitride of metals.

EXAMPLE 7

Cermet substrates were prepared according to the procedure of Example 1 using the same powder materials, the cermet substrates having the same composition as the cermet substrates of Example 1. The cermet substrates were then ground into a shape conforming to JIS·SNP432. The cermet substrates were then subjected to heat treatment in an atmosphere of $N_2$ under conditions shown in Table 8 to form a first reaction layer of carbo-nitride of metals on a surface thereof. Subsequently, the cermet substrates were subjected to heat treatment in an atmosphere of $CO_2$ under conditions shown in Table 8 to form an outer reaction layer of oxy-carbo-nitride of metals in the first reaction layer, thereby producing blade members 39 to 45 of this invention and comparison blade members 25 and 26. The comparison blade members 25 and 26 were produced under the conditions not falling within the range of this invention, as shown in Table 8. Also, there were provided comparison blade member 27 of cermet containing TiC, Ni and Mo and WC-based comparison blade member 28 having on a surface 6 μm thick coating composed of a layer of TiC and a layer of $Al_2O_3$.

The blade members 39 to 45 of this invention and the comparison blade members 25 to 28 were subjected to a continuous cutting test and an intermittent cutting test for the same purposes in the above Examples.

The conditions for the continuous cutting test were as follows:

Workpiece: a bar of steel (JIS·SNCM-8; Hardness: HB240)
Cutting speed: 260 m/minute
Feed rate: 0.375 mm/revolution
Depth of cut: 2.0 mm
Time: 10 minutes The conditions for the intermittent cutting test were as follows:

Workpiece: a block of steel (JIS·SNCM-8; Hardness: HB280)
Cutting speed: 150 m/minute
Feed rate: 0.33 mm/revolution
Depth of cut: 2.0 mm
Time: 3 minutes The results obtained are shown in Table 8.

TABLE 8

| Kind of blade member | Heat treatment: Inner layer: Pressure of $N_2$ (torr) | Heat treatment: Inner layer: Heat temperature (°C.) | Heat treatment: Inner layer: Time (h) | Heat treatment: Outer layer: Pressure of $CO_2$ (torr) | Heat treatment: Outer layer: Heat temperature (°C.) | Heat treatment: Outer layer: Time (h) | Reaction layer: Inner layer: Composition of carbo-nitride of metals: (Ti, M) (CxNy) (molar ratio) | Reaction layer: Inner layer: Average thickness (μm) |
|---|---|---|---|---|---|---|---|---|
| Blade member of this invention | | | | | | | | |
| 39 | 600 | 1240 | 8 | 300 | 1250 | 6 | $(Ti_{0.85}Ta_{0.05}W_{0.03}Mo_{0.07})$—$(C_{0.18}N_{0.82})$ | 3.0 |
| 40 | 550 | 1250 | 7 | 250 | 1260 | 5 | $(Ti_{0.85}Ta_{0.05}W_{0.03}Mo_{0.07})$—$(C_{0.15}N_{0.85})$ | 3.5 |
| 41 | 500 | 1260 | 6 | 200 | 1270 | 4 | $(Ti_{0.87}Ta_{0.05}W_{0.03}Mo_{0.05})$—$(C_{0.15}N_{0.85})$ | 3.5 |
| 42 | 450 | 1270 | 5 | 200 | 1280 | 3 | $(Ti_{0.87}Ta_{0.05}W_{0.03}Mo_{0.05})$—$(C_{0.17}N_{0.83})$ | 3.5 |
| 43 | 400 | 1280 | 7 | 250 | 1280 | 6 | $(Ti_{0.88}Ta_{0.04}W_{0.03}Mo_{0.05})$—$(C_{0.20}N_{0.80})$ | 5.5 |
| 44 | 450 | 1290 | 11 | 300 | 1290 | 7 | $(Ti_{0.90}Ta_{0.04}W_{0.03}Mo_{0.03})$—$(C_{0.25}N_{0.75})$ | 8.0 |
| 45 | 550 | 1300 | 12 | 300 | 1300 | 9 | $(Ti_{0.92}Ta_{0.03}W_{0.02}Mo_{0.03})$—$(C_{0.30}N_{0.70})$ | 10.0 |

TABLE 8-continued

| | | | | | | | | |
|---|---|---|---|---|---|---|---|---|
| Comparison blade members | | | | | | | | |
| 25 | 550 | 1320* | 15 | 300 | 1300 | 6 | $(Ti_{0.94}Ta_{0.02}W_{0.02}Mo_{0.02})$—$(C_{0.41}N_{0.59})$ | 16.0 |
| 26 | 550 | 1300 | 6 | 400 | 1330* | 18 | $(Ti_{0.92}Ta_{0.03}W_{0.02}Mo_{0.03})$—$(C_{0.35}N_{0.65})$ | 5.0 |
| 27 | | | | | — | | | |
| 28 | | | | | — | | | |

| | Reaction layer Outer layer | | | | |
|---|---|---|---|---|---|
| Kind of blade member | Composition of oxy-carbo-nitride of metals: (Ti, M) $(C_xN_yO_z)$ (molar ratio) | Average thickness (μm) | Continuous cutting test Flank wear (mm) | Continuous cutting test Crater wear (μm) | Intermittent cutting test Number of chipped blade members/ number of tested members |
| Blade member of this invention | | | | | |
| 39 | $(Ti_{0.90}Ta_{0.04}W_{0.02}Mo_{0.04})$—$(C_{0.35}N_{0.53}O_{0.12})$ | 0.7 | 0.13 | 20 | 0/10 |
| 40 | $(Ti_{0.90}Ta_{0.04}W_{0.02}Mo_{0.04})$—$(C_{0.35}N_{0.50}O_{0.15})$ | 1.0 | 0.11 | 15 | 1/10 |
| 41 | $(Ti_{0.92}Ta_{0.03}W_{0.02}Mo_{0.03})$—$(C_{0.35}N_{0.50}O_{0.15})$ | 1.0 | 0.10 | 15 | 1/10 |
| 42 | $(Ti_{0.92}Ta_{0.03}W_{0.02}Mo_{0.03})$—$(C_{0.40}N_{0.43}O_{0.17})$ | 1.0 | 0.09 | 15 | 1/10 |
| 43 | $(Ti_{0.92}Ta_{0.03}W_{0.02}Mo_{0.03})$—$(C_{0.43}N_{0.40}O_{0.17})$ | 2.0 | 0.09 | 10 | 2/10 |
| 44 | $(Ti_{0.95}Ta_{0.02}W_{0.01}Mo_{0.02})$—$(C_{0.45}N_{0.35}O_{0.20})$ | 3.5 | 0.13 | 5 | 3/10 |
| 45 | $(Ti_{0.95}Ta_{0.02}W_{0.01}Mo_{0.02})$—$(C_{0.48}N_{0.30}O_{0.22})$ | 4.5 | 0.15 | 5 | 5/10 |
| Comparison blade members | | | | | |
| 25 | $(Ti_{0.97}Ta_{0.01}Mo_{0.02})$—$(C_{0.55}N_{0.23}O_{0.22})$ | 3.0 | 0.26 | 5 | 10/10 |
| 26 | $(Ti_{0.95}Ta_{0.02}W_{0.01}Mo_{0.02})$—$(C_{0.50}N_{0.25}O_{0.25})$ | 11.0* | 0.22 | 5 | 10/10 |
| 27 | — | | 0.42 | 70 | 10/10 |
| | | | Plastic deformation | | |
| 28 | — | | 0.39 | 120 | 5/10 |
| | | | Plastic deformation | | |

*not falling within this invention

As can be seen from Table 8, the blade members 39 to 45 of this invention were much superior to the comparison blade members 27 and 28 in wear resistance, thermoplastic deformation resistance and toughness. The comparison blade member 25 had 16.0 μm thick inner layer which exceeded the upper limit of the thickness range of this invention. The comparison blade member 26 had 11.0 μm thick outer layer which exceeded the upper limit of the thickness range of this invention. These comparison blade members 25 and 26 were much inferior in toughness.

EXAMPLE 8

The same powder materials described in Example 2 were mixed together in ratios shown in Table 6 to provide various mixtures. Cermet substrates 8a to 14a and comparison substrates 5a to 8a were produced from these mixtures according to the same procedure of Example 2. Then, the cermet substrates 8a to 14a of this invention were subjected to heat treatment under conditions shown in Table 9 to produce blade members 46 to 52 of this invention, respectively. Also, the comparison substrates 5a to 8a were subjected to heat treatment under conditions shown in Table 9 to produce comparison blade members 29 to 32, respectively. The comparison blade members 29 and 30 had free carbon in their reaction layers and at portions immediately adjacent thereto. The comparison blade member 31 had an extremely roughened surface.

The blade members 46 to 52 of this invention and the comparison blade members 29 to 32 were subjected to a continuous cutting test. The conditions for this continuous cutting test were as follows:

Workpiece: a bar of steel (JIS·SNCM-8; Hardness: HB240)
Cutting speed: 210 m/minute
Feed rate: 0.36 mm/revolution
Depth of cut: 2.0 mm
Time: 10 minutes An intermittent cutting test was also carried out under the following conditions:

Workpiece: a block of steel (JIS·SNCM-8; Hardness: HB280)
Cutting speed: 130 m/minute
Feed rate: 0.3 mm/revolution
Depth of cut: 2.0 mm
Time: 3 minutes The results of these two tests are shown in Table 9.

TABLE 9

| Kind of blade member | Heat treatment: Inner layer: Pressure of $N_2$ (torr) | Heat temperature (°C.) | Time (h) | Outer layer: Pressure of $CO_2$ (torr) | Pressure of CO (torr) | Heat temperature (°C.) | Time (h) | Reaction layer Inner layer: Composition of carbo-nitride of metals: (Ti, M) (CxNy) (molar ratio) | Average thickness (μm) |
|---|---|---|---|---|---|---|---|---|---|
| Blade members of this invention | | | | | | | | | |
| 46 | 500 | 1280 | 5 | | 200 | 1280 | 3 | $(Ti_{0.82}W_{0.04}Mo_{0.14})$—$(C_{0.20}N_{0.80})$ | 3.5 |
| 47 | | | | | | | | $(Ti_{0.89}W_{0.03}Mo_{0.08})$—$(C_{0.18}N_{0.82})$ | 4.0 |
| 48 | | | | — | | | | $(Ti_{0.91}W_{0.03}Mo_{0.06})$—$(C_{0.15}N_{0.85})$ | 4.0 |
| 49 | 300 | | | | 100 | | | $(Ti_{0.92}W_{0.03}Mo_{0.05})$—$(C_{0.12}N_{0.88})$ | 4.0 |
| 50 | | | | | | | | $(Ti_{0.94}W_{0.02}Mo_{0.04})$—$(C_{0.08}N_{0.92})$ | 4.0 |
| 51 | 500 | | | 100 | | | | $(Ti_{0.81}Ta_{0.07}Nb_{0.02}W_{0.05}Mo_{0.05})$—$(C_{0.16}N_{0.84})$ | 3.5 |
| 52 | | | | | | | | $(Ti_{0.90}Ta_{0.02}W_{0.03}Mo_{0.05})$—$(C_{0.16}N_{0.84})$ | 4.0 |
| Comparison blade members | | | | | | | | | |
| 29 | | | | | 200 | | | $(Ti_{0.87}W_{0.03}Mo_{0.10})$—$(C_{0.56}N_{0.44})$ | 3.0 |
| 30 | | | | — | | | | $(Ti_{0.89}W_{0.03}Mo_{0.08})$—$(C_{0.30}N_{0.70})$ | 3.5 |
| 31 | 300 | | | | 100 | | | $(Ti_{0.95}W_{0.02}Mo_{0.30})$—$(C_{0.05}N_{0.95})$ | 4.0 |
| 32 | 500 | | | | 200 | | | Ti—$(C_{0.20}N_{0.80})$ | 4.0 |

| Kind of blade member | Reaction layer Outer layer: Composition of oxy-carbo-nitride of metals: (Ti, M) (CxNyOz) (molar ratio) | Average thickness (μm) | Continuous cutting test: Flank wear (mm) | Craft wear (μm) | Intermittent Cutting test Number of Chipped blade members/number of tested members |
|---|---|---|---|---|---|
| Blade members of this invention | | | | | |
| 46 | $(Ti_{0.93}W_{0.02}Mo_{0.05})$—$(C_{0.40}N_{0.45}O_{0.15})$ | 1.0 | 0.11 | 15 | 3/10 |
| 47 | $(Ti_{0.94}W_{0.02}Mo_{0.04})$—$(C_{0.40}N_{0.45}O_{0.15})$ | 1.0 | 0.10 | 10 | 2/10 |
| 48 | $(Ti_{0.94}W_{0.02}Mo_{0.04})$—$(C_{0.38}N_{0.45}O_{0.17})$ | 1.0 | 0.09 | 10 | 1/10 |
| 49 | $(Ti_{0.95}W_{0.02}Mo_{0.03})$—$(C_{0.33}N_{0.50}O_{0.17})$ | 1.0 | 0.10 | 10 | 2/10 |
| 50 | $(Ti_{0.97}W_{0.01}Mo_{0.02})$—$(C_{0.25}N_{0.55}O_{0.20})$ | 1.0 | 0.15 | 10 | 3/10 |
| 51 | $(Ti_{0.92}Ta_{0.03}Nb_{0.01}W_{0.02}Mo_{0.02})$ $(C_{0.38}N_{0.45}O_{0.17})$ | 1.0 | 0.13 | 15 | 1/10 |
| 52 | $(Ti_{0.96}Ta_{0.01}W_{0.01}Mo_{0.02})$ $(C_{0.38}N_{0.45}O_{0.17})$ | 1.0 | 0.11 | 15 | 1/10 |
| Comparison blade members | | | | | |
| 29 | $(Ti_{0.94}W_{0.01}Mo_{0.05})$—$(C_{0.60}N_{0.33}O_{0.07})$ | 1.0 | 0.30 | 40 | 10/10 |
| 30 | $(Ti_{0.95}W_{0.01}Mo_{0.04})$—$(C_{0.45}N_{0.45}O_{0.10})$ | 1.0 | 0.28 | 30 | 7/10 |
| 31 | $(Ti_{0.98}W_{0.01}Mo_{0.01})$—$(C_{0.25}N_{0.50}O_{0.25})$ | 1.0 | 0.35 | 15 | 9/10 |
| 32 | Ti—$(C_{0.40}N_{0.45}O_{0.15})$ | 1.0 | 0.25 | 30 | 10/10 |

As can be seen from Table 9, the blade members 46 to 52 exhibited excellent wear resistance and excellent toughness and achieved a good cutting performance. On the other hand, the comparison blade members 29 to 32 whose substrates had the compositions not falling within the range of this invention, were very inferior in wear resistance toughness and exhibited a poor cutting performance.

EXAMPLE 9

Cermet substrates, composed of 26.5% by volume TiC, 20% TiN, 10% TaC, 15% WC, 10% Mo, 5.5% Ni, 11% Co and 2% Al (the volume ratio of TiN to TiC plus TiN: 0.43), were prepared according to the procedure of Example 1. The cermet substrates were subjected to heat treatment under conditions shown in Table 10 to produce blade members 53 to 57 of this invention and comparison blade members 33 to 36. The cermet substrate not subjected to the heat treatment was used as comparison blade member 36. Also, there were provided WC-based comparison blade member 37 (JIS·P10) and comparison WC-based blade member 38 having on a surface 7 μm thick coating composed of TiC layer and TiN layer.

The blade members 53 to 57 of this invention and the comparison blade members 33 to 38 were subjected to a continuous cutting test. The conditions for this continuous cutting test were as follows:

Workpiece: a bar of steel (JIS·SNCM-8; Hardness: HB240)

Cutting speed: 150 m/minute

Feed rate: 0.475 mm/revolution

Depth of cut: 2.0 mm

Time: 15 minutes

An intermittent cutting test was also carried out under the following cutting conditions:

Workpiece: a block of steel (JIS·SNCM-8; Hardness: HB280)

Cutting speed: 110 m/minute

Feed rate: 0.375 mm/revolution

Depth of cut: 2.0 mm

Time: 3 minutes

The results of the continuous and intermittent cutting tests are shown in Table 10.

TABLE 10

| Kind of blade member | Heat treatment: Inner layer: Pressure of $N_2$ (torr) | Heat temperature (°C.) | Time (h) | Outer layer: Pressure of $CO_2$ (torr) | Pressure of CO (torr) | Heat temperature (°C.) | Time (h) | Reaction layer Inner layer: Composition of carbo-nitride of metals: (Ti, M) (CxNy) (molar ratio) | Average thickness (μm) |
|---|---|---|---|---|---|---|---|---|---|
| Blade members of this invention | | | | | | | | | |
| 53 | 200 | 1100 | 10 | — | 100 | 1100 | 10 | Not measurable | 0.3 |
| 54 | | 1150 | | | | 1150 | | Not measurable | 0.6 |
| 55 | 300 | 1200 | 10 | | | 1200 | 10 | $(Ti_{0.82}Ta_{0.08}W_{0.05}Mo_{0.05})$—$(C_{0.30}N_{0.70})$ | 2.0 |
| 56 | 400 | 1260 | 5 | 100 | | 1260 | 6 | $(Ti_{0.87}Ta_{0.06}W_{0.04}Mo_{0.03})$—$(C_{0.16}N_{0.84})$ | 2.5 |
| 57 | 500 | 1280 | 5 | | | 1280 | 4 | $(Ti_{0.88}Ta_{0.06}W_{0.03}Mo_{0.03})$ $(C_{0.15}N_{0.85})$ | 3.0 |
| Comparison blade members | | | | | | | | | |
| 33 | 200 | 1050* | 12 | | | — | | Not measurable | 0.2 |
| 34 | | — | | — | 100 | 1050 | 10 | — | — |
| 35 | 200 | 1050 | 10 | | | | | Not measurable | 0.1* |
| 36 | | | | | | — | | | |
| 37 | | | | | | — | | | |
| 38 | | | | | | — | | | |

| Kind of blade member | Reaction layer Outer layer: Composition of oxy-carbo-nitride of metals: (Ti, M) (CxNyOz) (molar ratio) | Average thickness (μm) | Continuous cutting test: Flank wear (mm) | Crater wear (μm) | Intermittent cutting test Number of chipped blade members/ number of tested members |
|---|---|---|---|---|---|
| Blade members of this invention | | | | | |
| 53 | Not measurable | 0.2 | 0.19 | 30 | 0/10 |
| 54 | Not measurable | 0.4 | 0.14 | 20 | 0/10 |
| 55 | $(Ti_{0.90}Ta_{0.04}W_{0.03}Mo_{0.03})$—$(C_{0.35}N_{0.55}O_{0.10})$ | 1.0 | 0.11 | 10 | 1/10 |
| 56 | $(Ti_{0.92}Ta_{0.04}W_{0.02}Mo_{0.02})$—$(C_{0.35}N_{0.50}O_{0.15})$ | 1.0 | 0.10 | 10 | 1/10 |
| 57 | $(Ti_{0.92}Ta_{0.04}W_{0.02}Mo_{0.02})$—$(C_{0.40}N_{0.43}O_{0.17})$ | 1.5 | 0.09 | 5 | 1/10 |
| Comparison blade members | | | | | |
| 33 | — | — | 0.40 | 70 | 0/10 |
| 34 | Not measurable | 0.1* | 0.36 | 50 | 0/10 |
| 35 | Not measurable | 0.1* | 0.29 | 45 | 0/10 |
| 36 | — | | 0.48 | 80 | 1/10 |
| 37 | — | | 0.57 | 170 | 5/10 |
| 38 | — | | 0.40 | 80 | 3/10 |

*not falling within the range of this invention

As can be seen from Table 10, the blade members 53 to 57 of this invention exhibited excellent wear resistance and excellent toughness in comparison with the comparison blade members 37 and 38. The reaction layer of each of the comparison blade members 33 to 35 were below the lower limit of the thickness range of this invention. Further, the reaction layer of each of the comparison blade members 33 and 34 was a single layer. The comparison blade member 36 had no reaction layer. Although these comparison blade members 33 to 36 were substantially equal in toughness to the blade members of this invention, they were quite inferior in wear resistance.

What is claimed is:

1. A blade member for cutting tools which comprises a substrate of cermet containing, apart from impurities, 10 to 35% by volume of at least one metal selected from the group consisting of Fe, Co, Ni, Cr, Mo, W and Al, 5 to 40% by volume of at least one compound selected from the group consisting of carbides and nitrides of metals in groups $IV_A$, $V_A$ and $VI_A$ of the periodic table, and balance titanium carbide and titanium nitride, in which the volume ratio of titanium nitride to titanium carbide plus titanium nitride is 0.2 to 0.6, said substrate having on a surface thereof a reaction layer composed of carbo-nitride of at least two metals in groups $IV_A$, $V_A$ and $VI_A$ of the periodic table, said at least two metals including Ti, said reaction layer having an average thickness of 0.5 to 15.0 μm, and the concentration of titanium in said reaction layer increases toward the surface thereof.

2. A blade member for cutting tools which comprises a substrate of cermet containing, apart from impurities, 10 to 35% by volume of at least one metal selected from the group consisting of Fe, Co, Ni, Cr, Mo, W and Al, 5 to 40% by volume of at least one compound selected from the group consisting of carbides and nitrides of metals in groups $IV_A$, $V_A$ and $VI_A$ of the periodic table, and balance titanium carbide and titanium nitride, in which the volume ratio of titanium nitride to titanium carbide plus titanium nitride is 0.2 to 0.6, said substrate having on a surface thereof a reaction layer composed of oxy-carbo-nitride of at least two metals in groups $IV_A$, $V_A$ and $VI_A$ of the periodic table, said at least two metals including Ti, said reaction layer having an average thickness of 0.5 to 15.0 μm, and the concentration of titanium in said reaction layer increases toward the surface thereof.

3. A blade member for cutting tools which comprises a substrate of cermet containing, apart from impurities, 10 to 35% by volume of at least one metal selected from the group consisting of Fe, Co, Ni, Cr, Mo, W and Al, 5 to 40% by volume of at least one compound selected from the group consisting of carbides and nitrides of metals in groups $IV_A$, $V_A$ and $VI_A$ of the periodic table, and balance titanium carbide and titanium nitride, in which the volume ratio of titanium nitride to titanium carbide plus titanium nitride is 0.2 to 0.6, said substrate having on a surface thereof a reaction layer consisting of inner and outer layers, said inner layer being composed of carbo-nitride of at least two metals, in groups $IV_A$, $V_A$ and $VI_A$ of the periodic table, said at least two metals including Ti, and said inner layer having an average thickness of 0.2 to 15.0 μm, said outer layer being composed of oxy-carbo-nitride of at least two metals in groups $IV_A$, $V_A$ and $VI_A$ of the periodic table, said at least two metals including Ti, said outer layer having an average thickness of 0.2 to 10.0 μm, the combined average thickness of said inner and outer layers being 0.5 to 20.0 μm, and the concentration of titanium of each of said inner and outer layers of said reaction layer increases toward the surface thereof.

4. A process for producing a blade member for cutting tools, which comprises the steps of:

(a) mixing, apart from impurities, 10 to 35% by volume of at least one metal selected from the group consisting of Fe, Co, Ni, Cr, Mo, W and Al, 5 to 40% by volume of at least one compound selected from the group consisting of carbides and nitrides of metals in groups $IV_A$, $V_A$ and $VI_A$ of periodic table, and balance titanium carbide and titanium nitride (the volume ratio of titanium nitride to titanium carbide plus titanium nitride is 0.2 to 0.6) to form a mixture, the above components being in the form of powder;

(b) compacting the powder mixture into a densified solid body;

(c) sintering the densified solid body under vacuum of not more than $10^{-1}$ torr to form a substrate of cermet; and (d) heating the substrate in an atmosphere of nitrogen gas at temperatures of 1100° to 1300° C. so that a reaction layer is formed on a surface of the substrate, the reaction layer being composed of carbo-nitride of at least two metals in groups $IV_A$, $V_A$ and $VI_A$ of the periodic table, said at least two metals including Ti, and said reaction layer having an average thickness of 0.5~15.0 μm.

5. A process for producing a blade member for cutting tools, which comprises the steps of:

(a) mixing, apart from impurities, 10 to 35% by volume of at least one metal selected from the group consisting of Fe, Co, Ni, Cr, Mo, W and Al, 5 to 40% by volume of at least one compound selected from the group consisting of carbides and nitrides of metals in groups $IV_A$, $V_A$ and $VI_A$ of the periodic table, and balance titanium carbide and titanium nitride (the volume ratio of titanium nitride to titanium carbide plus titanium nitride is 0.2 to 0.6) to form a mixture, the above components being in the form of powder;

(b) compacting the powder mixture into a densified solid body;

(c) sintering the densified solid body under vacuum of not more than $10^{-1}$ torr to form a substrate of cermet; and (d) heating the substrate at temperatures of 1100° to 1300° C. in an atmosphere of at least one gas selected from the group consisting of CO and $CO_2$ so that a reaction layer is formed on a surface of the substrate, the reaction layer being composed of oxy-carbo-nitride of at least two metals in groups $IV_A$, $V_A$ and $VI_A$ of the periodic table, said at least two metals including Ti, and said reaction layer having an average thickness of 0.5~10.0 μm.

6. A process according to claim 5, in which said atmosphere further includes $N_2$.

7. A process for producing a blade member for cutting tools, which comprises the steps of:

(a) mixing, apart from impurities, 10 to 35% by volume of at least one metal selected from the group consisting of Fe, Co, Ni, Cr, Mo, W and Al, 5 to 40% by volume of at least one compound selected from the group consisting of carbides and nitrides of metals in groups $IV_A$, $V_A$ and $VI_A$ of the periodic table, and balance titanium carbide and titanium nitride (the volume ratio of titanium nitride to titanium carbide plus titanium nitride is 0.2 to 0.6) to form a mixture, the above components being in the form of powder;

(b) compacting the powder mixture into a densified solid body;

(c) sintering the densified solid body under vacuum of not more than $10^{-1}$ torr to form a substrate of cermet; and (d) heating the substrate at temperatures of 1100° to 1300° C. in an atmosphere of $N_2$ so that a reaction layer is formed on a surface of the substrate, the reaction layer being composed of carbo-nitride of at least two metals in groups $IV_A$, $V_A$ and $VI_A$ of the periodic table, said at least two metals including Ti, and said reaction layer having an average thickness of 0.5~20.0 μm.

(e) subsequently heating the substrate at temperatures of 1100° to 1300° C. in an atmosphere of at least one gas selected from the group consisting of CO and $CO_2$ so that an outer reaction layer is formed in the surface of the reaction layer, said outer reaction layer being composed of oxy-carbo-nitride of at least two metals in groups $IV_A$, $V_A$ and $VI_A$ of the periodic table, said at least two metals including Ti, said outer layer having an average thickness of 0.2 to 10.0 μm, and the inner portion of said reaction layer adjacent to said outer layer having an average thickness of 0.2 to 15.0 μm, and the combined average thicknesses of said inner portion and said outer layer being 0.5 to 20.0 μm.

* * * * *